US011912446B2

(12) United States Patent
Zhang

(10) Patent No.: US 11,912,446 B2
(45) Date of Patent: Feb. 27, 2024

(54) GASKET PLACEMENT MECHANISM FOR HIGH SPEED WIRE ROD BALING MACHINE AND GASKET STRUCTURE

(71) Applicant: Shanghai Winlong Energy Conservation & Environmental Protection Technology Co., Ltd, Shanghai (CN)

(72) Inventor: Xuesong Zhang, Shanghai (CN)

( * ) Notice: Subject to any disclaimer, the term of this patent is extended or adjusted under 35 U.S.C. 154(b) by 408 days.

(21) Appl. No.: 17/258,166

(22) PCT Filed: Jun. 20, 2019

(86) PCT No.: PCT/CN2019/092161
§ 371 (c)(1),
(2) Date: Jan. 6, 2021

(87) PCT Pub. No.: WO2020/007204
PCT Pub. Date: Jan. 9, 2020

(65) Prior Publication Data

US 2021/0276746 A1 Sep. 9, 2021

(30) Foreign Application Priority Data

Jul. 6, 2018 (CN) ..... 201810736901.5
Jul. 6, 2018 (CN) ..... 201810737934.1
(Continued)

(51) Int. Cl.
*B65B 27/06* (2006.01)
*B65B 13/20* (2006.01)

(52) U.S. Cl.
CPC ..... *B65B 27/06* (2013.01); *B65B 13/20* (2013.01)

(58) Field of Classification Search
None
See application file for complete search history.

(56) References Cited

U.S. PATENT DOCUMENTS

2005/0184450 A1* 8/2005 Charvet ..... B65B 27/06 271/121

FOREIGN PATENT DOCUMENTS

CN 205525741 U * 8/2016
CN 205525741 U 8/2016
(Continued)

*Primary Examiner* — Tanzim Imam

(57) ABSTRACT

The invention discloses a gasket placement mechanism for a high speed wire rod baling machine and a related gasket structure. The baling machine comprises two pressing plates (2) reciprocating in the direction of compression, and filing-prevention disks (25) which are in a circular shape and have a certain thickness are fixed on two opposite compression surfaces of the pressing plates. Four diagonals of the pressing plates along with the filing-prevention disks are provided with four wire grooves (18) banding steel wires, and four diagonals of the pressing plates are respectively provided with conveying rollers (16) and gasket rolls (17). A numerical control motor drives the conveying rollers to rotate so as to drive the gasket rolls to be unfolded horizontally, and the unfolded gaskets (14) penetrate through a channel formed by the filing-prevention disks to reach the position of the wire grooves of the pressing plates. The gaskets are in a parallelogram shape or a long and narrow rectangle shape, and the adjacent gaskets are connected by means of the hypotenuses or long edges; sawtooth holes (14*c*) or line-like concave indentations are provided; conveying tooth holes (14*a*) are provided at the corresponding unfolded positions of the gasket rollers. The gasket placement mechanism achieves the mechanization and automation for gasket placement, specialized production of the gasket is facilitated, and operating efficiency is improved.

9 Claims, 8 Drawing Sheets

(30) Foreign Application Priority Data

| | | |
|---|---|---|
| Jul. 6, 2018 | (CN) | 201810738657.6 |
| Nov. 9, 2018 | (CN) | 201811330172.X |
| Nov. 9, 2018 | (CN) | 201811330176.8 |
| Nov. 9, 2018 | (CN) | 201811330178.7 |
| Mar. 29, 2019 | (CN) | 201910248708.1 |
| Mar. 29, 2019 | (CN) | 201910248727.4 |
| Mar. 29, 2019 | (CN) | 201910249222.X |

(56) References Cited

FOREIGN PATENT DOCUMENTS

| | | | |
|---|---|---|---|
| CN | 107933995 | A | 4/2018 |
| CN | 108773542 | A | 11/2018 |
| CN | 109305425 | A | 2/2019 |
| JP | 2014136599 | A | 7/2014 |
| KR | 20050022983 | A | 3/2005 |

* cited by examiner

GASKET PLACEMENT MECHANISM FOR HIGH SPEED WIRE ROD BALING MACHINE AND GASKET STRUCTURE

BACKGROUND OF THE INVENTION

1. Field of the Invention

The invention relates to an improved mechanism for a machine tool in the process of processing steel rods to form a wire rod in the field of iron and steel, in particular to a gasket placement mechanism for a high speed wire rod baling machine and a related gasket structure.

2. Description of the Related Art

Wire rod produced by steel mills is also called wire rod because it is delivered in wire rod. Before the high speed wire rod is bundled by the steel mills in this field, the high speed wire rod is directly bundled with a baling machine after the high speed wire rod is produced and formed, and the steel wire (belt) is tied directly to tighten the wire rod. Since the steel wire bundled by the baling machine is subject to greater tension, it is prone to strangulation at the contact with both sides of the wire rod; at the same time, during transportation, both sides of the wire rod are easily damaged by impact and friction, which affects the quality of high speed wire rods, leads to wire breakage in the subsequent drawing process of customers, affects the continuity of the production process, causes great product waste, increased production costs, and potential safety hazards in the production process.

In order to solve the problem, steel mills in various places have successively adopted manual placement methods to prevent high speed wire rods from strangling gaskets; before the high speed wire rod enters the baling machine, stick the cut anti-strangle gaskets on the eight baling lanes of the baling machine; after baling, the anti-strangle gaskets isolate the contact between the wire rod and the banding steel wire at both ends of the high speed wire rod, and provide protection to prevent the high speed wire rod from being damaged in the bundling and tightening area; at the same time, it also prevents the banding steel wire from contacting the wire during transportation, and the friction deepens the damage to the wire surface. However, in order to ensure the high speed production rhythm, this method requires workers to paste eight pieces on the exact position of the baling machine within one minute or so, which requires high labor skills and labor intensity, and is also dangerous for personnel to drill into the baling machine in a high temperature environment. Furthermore, the gasket is easy to fall off, easy to move, and cannot achieve the expected protective effect. Moreover, in order to withstand the high temperature of the high speed wire rod, the anti-strangle gasket must be made of high-temperature resistant chemical materials, and the cost of the gasket is relatively high.

Therefore, in order to improve work efficiency, reduce the labor intensity of workers, and eliminate potential safety hazards, steel mills in the field have adopted a more efficient method of placing gaskets to prevent high speed wire rods from strangling the gasket, and adopted "a high speed wire rod baling gasket" of CN202642408U or "a steel cord wire rod baling disk" of CN203127443U for bundling. In this kind of baling disk, the original four gaskets on each side are connected into a whole by four pieces of cardboard with card slots of the same shape, and the cardboard is a quarter-ring structure. That is, use four pieces of cardboard as the material of the gasket and paste them on a circular cardboard that is the same size as the filing-prevention disk of the baling machine. Workers hang a piece of prefabricated circular cardboard on each side of the wire rod hanging on the C-shaped transmission hook, which can avoid the action of workers drilling into the baling machine, reduce the labor intensity of the workers, and improve the production efficiency.

However, there are still five problems in the following five aspects of the process of manually placing the ring plate gasket to prevent the high speed wire rod from being strangled.

First, the environmental protection issue. In the process of manufacturing "a high speed wire rod baling gasket" and "a steel cord wire rod baling disk", a large amount of cardboard is needed to make support plates or substrates; papermaking is an industry that consumes ecological environment and high pollution; the gaskets used must be high temperature resistant; the gaskets are made of chemical raw materials, and the chemical industry is also a highly polluting industry.

During the use of steel mills, a large area of workshop space is required for stacking. After the bundling, a large amount of waste cardboard, rivets and other waste products were discarded in the processing workshop, which caused the working environment of the production workshop to become messy, and requires a lot of manual cleaning and rectification of the work site.

For the end user, the non-recyclable gasket is also a loss and harm to the ecological environment of the society, and there exists a problem of how to dispose the gasket made of chemical raw materials.

Second, the cost of baling gasket materials is high. At present, cardboard is used to make support plates or substrates, gaskets and rivets made of chemical raw materials, and a complete assembly needs to be made manually. The cost of gasket materials for each pack of wire rods in steel plants is very high.

Third, the baling quality issue. The process of placing gaskets currently used is prior to the baling machine starts the baling action, which is suspended, unstable and unreliable; the movement of the loose wire rod in the process of being compressed by the baling machine will cause the displacement of the substrate and gasket; after baling, the baling gasket will shift, fall off, and break under tension, and even some areas may not be covered, and the baling quality cannot be guaranteed. At the same time, due to the residual temperature of the high speed wire rod, the baling gasket made of chemical raw materials is heated and melted, and part of the contact area is not covered, so the baling quality is poor.

Fourth, the labor cost issue. The steel mill must arrange for 1 to 2 workers to stick the eight anti-strangle gaskets on the baling line of the baling machine, or hang two pieces of circular cardboard each with four pieces of anti-strangle gaskets on both sides of the high wire rod on the C-shaped transmission hook, which requires labor costs.

Fifth, the labor intensity of workers is high and there are potential safety hazards. Due to the high temperature of the high speed wire rod on the assembly line on site, there is a natural cooling process. Workers work in a high temperature and noisy environment, and need to stick 8 pieces of anti-strangle gaskets to the position of the baling line of the baling machine within one minute or so; the workload of workers is very large, and it is also dangerous for personnel to drill into the baling machine in a high temperature environment. Or workers have to repeatedly walk on both sides of the moving C-shaped transmission hook, and hang two pieces of circular cardboard with 4 pieces of anti-strangle gaskets on both sides of the loose high speed wire rod on the C-shaped transmission hook; one piece of cardboard needs to be opened and sealed with a C-shaped transmission hook, which makes the process complicated. In order to meet the rhythm of the assembly line, the labor intensity is very high; after the baling is completed, the workers are responsible for removing the cardboard, rivets and other accessories that are discarded on-site after baling, so the workers' labor is very heavy. In addition, the C-shaped transmission hook has also fallen off in steel mills, so the workers' working under the moving C-shaped transmission hook is also dangerous.

SUMMARY OF THE INVENTION

The purpose of the invention is to provide a gasket placement mechanism for a high speed wire rod baling machine and a gasket structure used for the high speed wire rod baling machine for overcoming and avoiding the various defects caused by the above two ways of adding gaskets, which can be more accurate and targeted to pad the gasket into the appropriate position of the baling machine before the wire rod is bundled, so as to achieve rapid placement and eliminate manual labor.

The purpose of the invention is achieved by the following technical solutions:

a gasket placement mechanism for a high speed wire rod baling machine, wherein the baling machine comprises two pressing plates reciprocating at both ends in the direction of compression;

filing-prevention disks which are in a circular shape and have a certain thickness are fixed on two opposite compression surfaces of the pressing plates; four diagonals of the pressing plates along with the filing-prevention disks are provided with four wire grooves banding steel wires, and the wire grooves divide the filing-prevention disks into four sector plates of upper, lower, left and right;

wherein:

four diagonals of the pressing plates are provided with conveying rollers and gasket rolls;

the gasket roll consists of a large number of gaskets connected side by side to form a long strip and wound into a roll shape, and the wrapping and winding direction of a single gasket is on both sides of the unfolded gasket roll;

a numerical control motor drives the conveying rollers to rotate so as to drive the gasket rolls to unfold the gaskets horizontally, and the unfolded gaskets penetrate through a channel formed by the filing-prevention disks to reach the position of the wire grooves of the pressing plates; pressing strips are provided at the notch of the wire grooves and above the gaskets;

the conveying roller is provided with at least one circle of protruding teeth in the circumferential direction for conveying the gaskets.

The high speed wire rod baling machine in the prior art is provided with a C-shaped transmission hook on the upper side, and the wire rod that has been produced and processed and has a higher temperature is hung on the horizontal hook of the transmission hook.

The left and right sides of the high speed wire rod baling machine are pressing plates; the wheels move back and forth on the track of the guide device, or move towards each other to compress the wire rod, and the steel wire is passed and tightened by the steel wire guide component, and then the steel wire is tightened and cut by the baling head to complete the baling, and then the two pressing plates move in opposite directions, and the C-shaped transmission hook removes the bundled wire rod to complete the baling task.

There is a lifting platform under the baling machine, which enables the wire rods hung on the transmission hook to be pierced more neatly before baling.

The opposing panels of the pressing plate of the baling machine are generally rectangular, made of steel, and the material is relatively hard. In order to prevent the pressing plate panel from damaging and squeezing the wire rod when squeezing the wire rod, causing damage to the wire rod and affecting the quality, a round or polygonal or other shape filing-prevention disk is generally fixed on the pressing plate panel; the material of the board is softer than steel, and the thickness of the board is about 30 mm. The effective diameter of the filing-prevention disk corresponds to the diameter of the wire rod ring formed before and after the wire rod is packed, which is slightly larger; in short, the rod material of the wire rod will not directly contact the surface of the pressing plate during extrusion. Since the whole rod is ring-shaped before and after baling, the filing-prevention disk is generally ring-shaped.

In order to pack evenly and securely, the banding steel wires are generally located at the four diagonal corners of the pressing plate and the horizontal at 45 degrees, so that the rods are banded in four perpendicular places. Therefore, there are four wire grooves for banding steel wires at the four diagonal corners of the pressing plate and the filing-prevention disk. Therefore, four diagonals of the pressing plate and the filing-prevention disk are provided with four wire grooves banding steel wires, and the wire grooves divide the filing-prevention disks into four sector plates of upper, lower, left and right. Since the upper sector filing-prevention disk needs to be lowered from the upper C-shaped transmission hook to place the wire rod, a vertical gap must be made in the middle, which causes the upper sector filing-prevention disk to form two small sectors with the rectangular gap in the middle.

The baling machine product of SUND BIRSTA of Sweden can be representative for this kind of baling machine.

The invention proposes for the first time in the field that four diagonals of the pressing plates are provided with conveying rollers and gasket rolls; a numerical control motor drives the conveying rollers to rotate so as to drive the gasket rolls to unfold the gaskets horizontally, and the unfolded gaskets penetrate through a channel formed by the filing-prevention disks to reach the position of the wire grooves of the pressing plates; pressing strips are provided at the notch of the wire grooves and above the gaskets. The mechanism avoids the manual placement of gaskets in high temperature and dangerous situations where people drill into the two pressing plates of the baling machine; there is no need to make the gasket prefabricated hanging ring in advance, and it also avoids manual work directly on the site.

As mentioned hereinabove, the wire grooves divide the filing-prevention disks into four sector plates of upper, lower, left and right; since the device is installed at the four opposite corners of the pressing plate, generally only the left and right sector filing-prevention disks are provided with two upper and lower gasket conveying and moving channels, which is clearly shown in FIG. 4.

Such a right expression also indicates that even if a gasket placement mechanism is provided on one side of the pressing plate, or any one to four of the groove positions of the side pressing plate, they all fall within the scope of the invention.

In order to make the gaskets be transported to the wire groove smoothly and reliably in standardized, two limit stop bars can be arranged in parallel between the conveying roller and the wire groove of the pressing plate, or a limit moving groove formed by the two sides of the filing-prevention disk letting out the channel can be set. In order to further improve the reliability, a flat long groove structure with a closed cross-section is formed by covering the flat plate outside the limit moving groove.

A gasket structure for the gasket placement mechanism for a high speed wire rod baling machine, wherein:

the gaskets are in a parallelogram shape, and the adjacent gaskets are connected by means of the hypotenuses; the oblique direction of the hypotenuses is consistent with the direction of the wire grooves on the pressing plates; saw-tooth holes or line-like concave indentations are provided between the adjacent gaskets;

or, the gaskets are in a long and narrow rectangle shape, and the adjacent gaskets (14) are connected by means of the long edges; the long edge thereof is at an oblique angle to the horizontal, and the oblique direction is consistent with the direction of the wire grooves on the pressing plates; saw-tooth holes or line-like concave indentations are provided between the adjacent gaskets;

the gaskets are metal sheets;

corresponding to the protruding teeth of the conveying roller in the circumferential direction, conveying tooth holes are provided at the corresponding unfolded positions of the gasket rollers.

Since the invention pushes the gaskets to the four diagonal groove positions by the gaskets continuous pushing mechanism, the relative position is "precise", therefore, it is completely unnecessary to make the gaskets very large as in the prior art "a high speed wire rod baling gasket" of CN202642408U or "a steel cord wire rod baling disk" of CN203127443U, so as to ensure that the gaskets are banded by the steel wire during baling and will not shift. The width of the gaskets of the invention is much smaller than that of the prior art two, and only one half to one third of the prior art two is required after testing.

According to the invention, "the gaskets are in a parallelogram shape or a long and narrow rectangle shape, and the adjacent gaskets are connected by means of the hypotenuses or long edges; the oblique direction of the hypotenuses is consistent with the direction of the wire grooves on the pressing plates"; for this reason, after the gasket rolls are unfolded, the long strip gaskets with a large number must be transported from the outside to the position of the wire groove in a horizontal direction. With such a structure, additional components and devices can be extended to the outside on the pressing plate and a larger space and position can be obtained.

In order to transport the long strip gaskets with a large number in a horizontal direction, the axis of the conveying rollers and the axis of the gasket rolls of the invention must be vertical. The vertical axis of the gasket rolls makes the center of gravity of the entire gasket roll more balanced, the conveying and unwinding operation is relatively stable, and the outer space is large, so that the gasket roll can be equipped with a large number of gaskets, which makes it possible to maintain a long operation time for one-time feeding of the gasket rolls and improve the working efficiency of the device.

If the upper and lower two continuous push mechanisms on the same side are used in an inclined configuration, the end of the output gasket is rectangular, which is exactly the same as the wire groove. However, due to the close position of the two baling wire grooves on the same side, the outer space is limited. The two sets of conveying rollers and gasket rolls are likely to interfere and "fight", and it is impossible to configure more gaskets. Repeated addition of gaskets reduces work efficiency.

"Sawtooth holes or line-like concave indentations are provided between the adjacent gaskets"; the tension force when the banding steel wire is drawn and tightened in the wire groove, just to tear the adjacent gaskets along the sawtooth holes or the line-like concave indentations, and the two processes of banding and tearing are integrated, which is also unique of the invention The sawtooth holes may be conventional short-distance holes or long-distance holes, as long as it can facilitate the horizontal transportation of the gasket rolls and facilitate the tearing of adjacent gaskets.

After the gaskets are installed, the banded steel wires do not directly contact the surface of the steel wire rods. In the process of banding, transportation and storage, the tightening movement or vibration movement of the steel wires occurs on the outer surface of the gaskets, and it will not directly contact, rub, damage, or affect the surface quality of the wire rods, which achieves the purpose of protecting the surface quality of the wire rods.

Corresponding to the protruding teeth of the conveying roller in the circumferential direction, conveying tooth holes are provided at the corresponding unfolded positions of the gasket rollers; the invention accurately conveys the gaskets of the gaskets rolls to the position of the wire groove, adopts a numerical control motor like a servo motor, and sets the time and length of the start and stop of the conveying; the circumferential protruding teeth of the conveying rollers move the gaskets to roll out the conveying tooth holes in the corresponding position on the gaskets.

The corresponding position of the gasket rolls of the invention is provided with conveying tooth holes. In addition to using the toothed rollers to drive of the invention, the method of toggling the gaskets to move can also be a reciprocating mechanism driven by an air cylinder, an oil cylinder or a linear motor. The reciprocating mechanism is provided with protruding teeth corresponding to the tooth holes, and the protruding teeth toggle the tooth holes of the gasket to roll and unfold the gaskets to transport the gaskets.

Further, the gaskets are aluminum sheets, copper sheets or steel sheets.

Further, the thickness of the gaskets is 0.1-1 mm.

Furthermore, the gaskets are steel sheets with a thickness of 0.2 mm.

the hypotenuses of the gaskets in a parallelogram shape or the long edges in a long and narrow rectangle shape form an angle of 45 degrees with the horizontal line.

Further, the unfolded upper and lower sides of the gasket rolls are respectively provided with a row of circular, rhombic or rectangular conveying tooth holes.

Further, banding guide holes are provided in the middle of the two horizontal sides of the gaskets in a parallelogram shape or the two short edges in a long and narrow rectangle shape.

Furthermore, the banding guide holes are semicircular holes with a diameter of 5-12 mm or rectangular holes with a width of 15-35 mm and a depth of 5-15 mm.

The superiorities and advantageous effects of the invention are as follows.

1. For the first time in the field, the invention proposes a technical solution that is different from the existing way of placing gaskets, which does not require manual on-site operation and is only undertaken by machines. It is a groundbreaking basic patent that will fundamentally change the way of operation in the field, and has significant technical effects and market and economic value.

2. The harsh working environment and defects caused by manual operation such as high temperature and unsafety are completely eliminated.

3. Gaskets are made in a targeted manner and are placed "precisely", which greatly saves gasket materials.

4. The cost of baling gasket materials is reduced. The baling gaskets used in the invention are sheet metal, that is, sheet metal materials, and the cost is much lower than that of the support plates or substrates made of cardboard, gaskets made of chemical raw materials, plastics, and rivets, plus the need to make a complete assembly manually. At present, the largest range of invention adopts a method similar to CN203127443U, which comprises four substrates with the same shape and four buffer material layers. The substrate is a quarter-ring structure. The substrates are connected end to end to form a circle, the outer diameter of the circle matches the outer diameter of the steel cord rod, and the two substrates are fixedly connected by a buffer material layer. The invention eliminates the so-called ring structure, which does not need to be made in advance, set in advance, and does not need to be torn off and dismantled after banding, saving labor, materials, and disposal of residual materials after dismantling. The sheet metal gaskets of the invention can be recycled at the end user and used as raw materials for steel smelting plants. In the invention, there is no additional waste such as cardboard, patches made of chemical raw materials, plastic rivets, etc. Clean and environmentally friendly, it has realized the environmental protection of baling gaskets from production, use, and disposal, and has made contributions to the realization of a green environment.

5. The technical details of the invention can ensure the saving of gasket materials and improve the quality of the gaskets pad during banding. Compared with manual, machine feeding can ensure the high consistency of each action, can improve the quality of baling, and reduce or even eliminate the phenomenon of deviation and shedding.

6. The gasket parts of the invention are consumables, which are used in huge quantities. They are designed and arranged in the manner of gasket rolls, which can save a large amount of consumables and funds, are convenient for professional production, and are supplied on a dedicated line, which greatly improves work efficiency and economic benefits.

The invention adopts mechanization and automation, which changes and liberates manual labor, improves the speed, efficiency, quality, and effect of work. The provision of gaskets is scientific, reasonable, economical, and suitable for batches, which has urgent application value.

Figure 1:
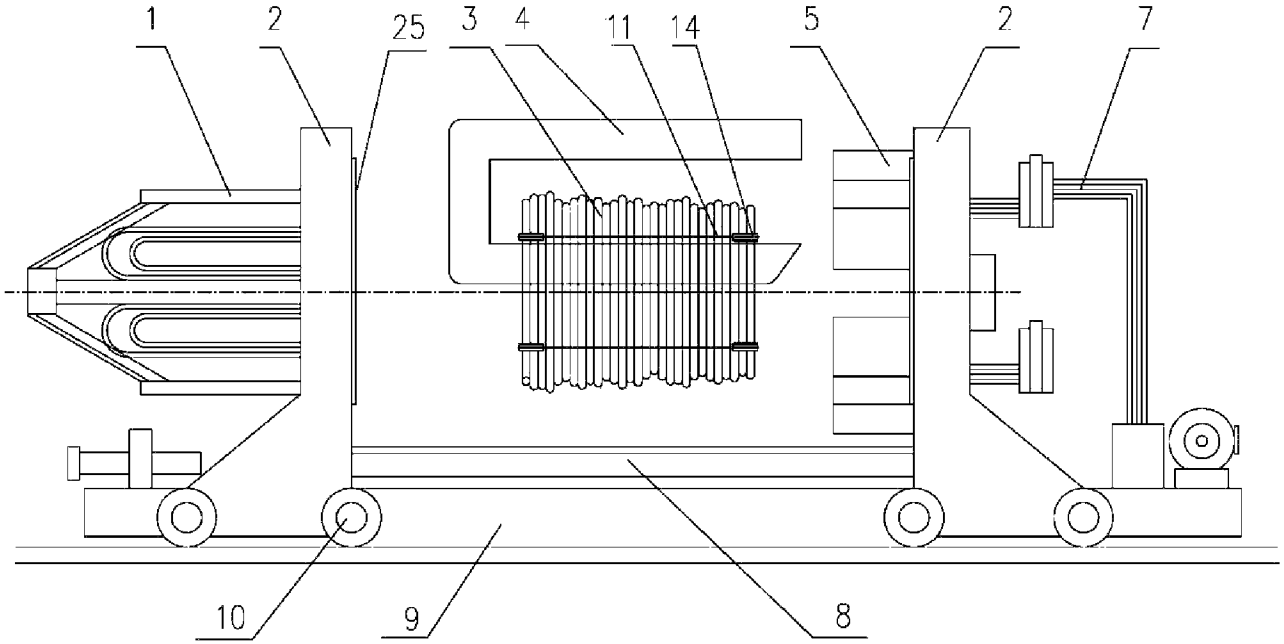
FIG. 1 is a schematic diagram of the overall configuration structure of a high speed wire rod baling machine in the prior art.
Figure 2:
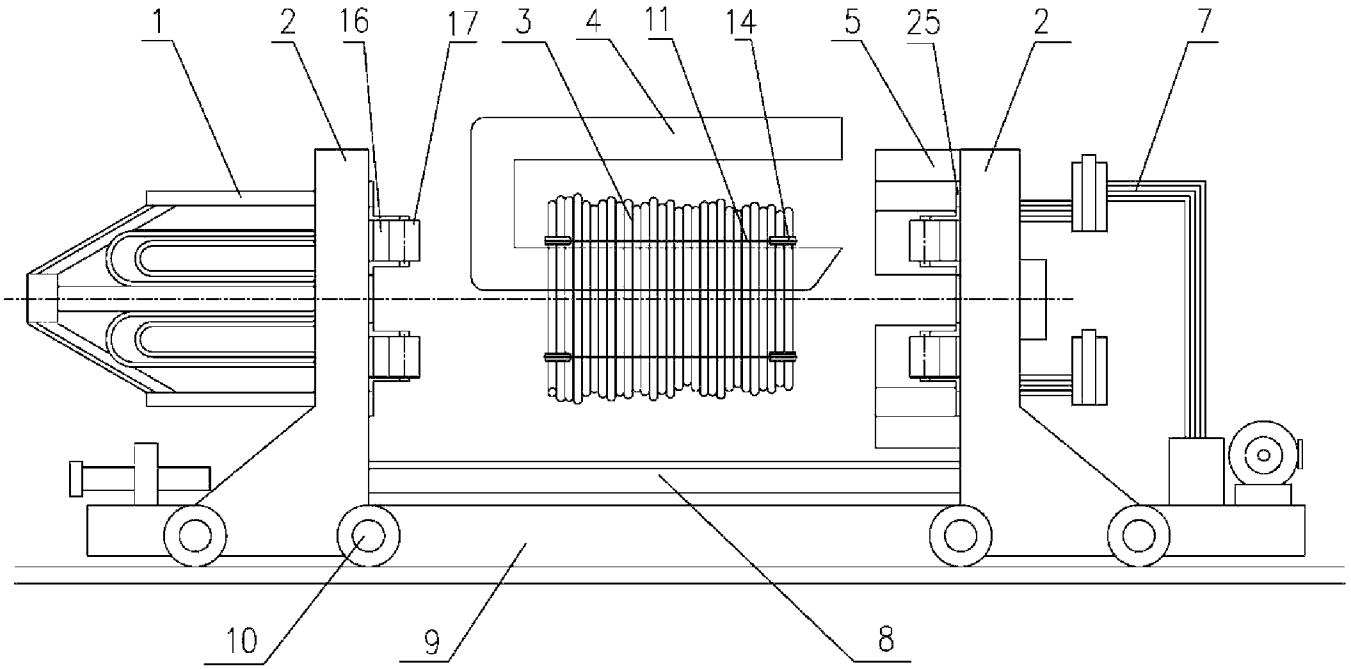
FIG. 2 is a schematic diagram of the overall configuration structure of an embodiment of a gasket placement mechanism for a high speed wire rod baling machine of the invention.
Figure 3:
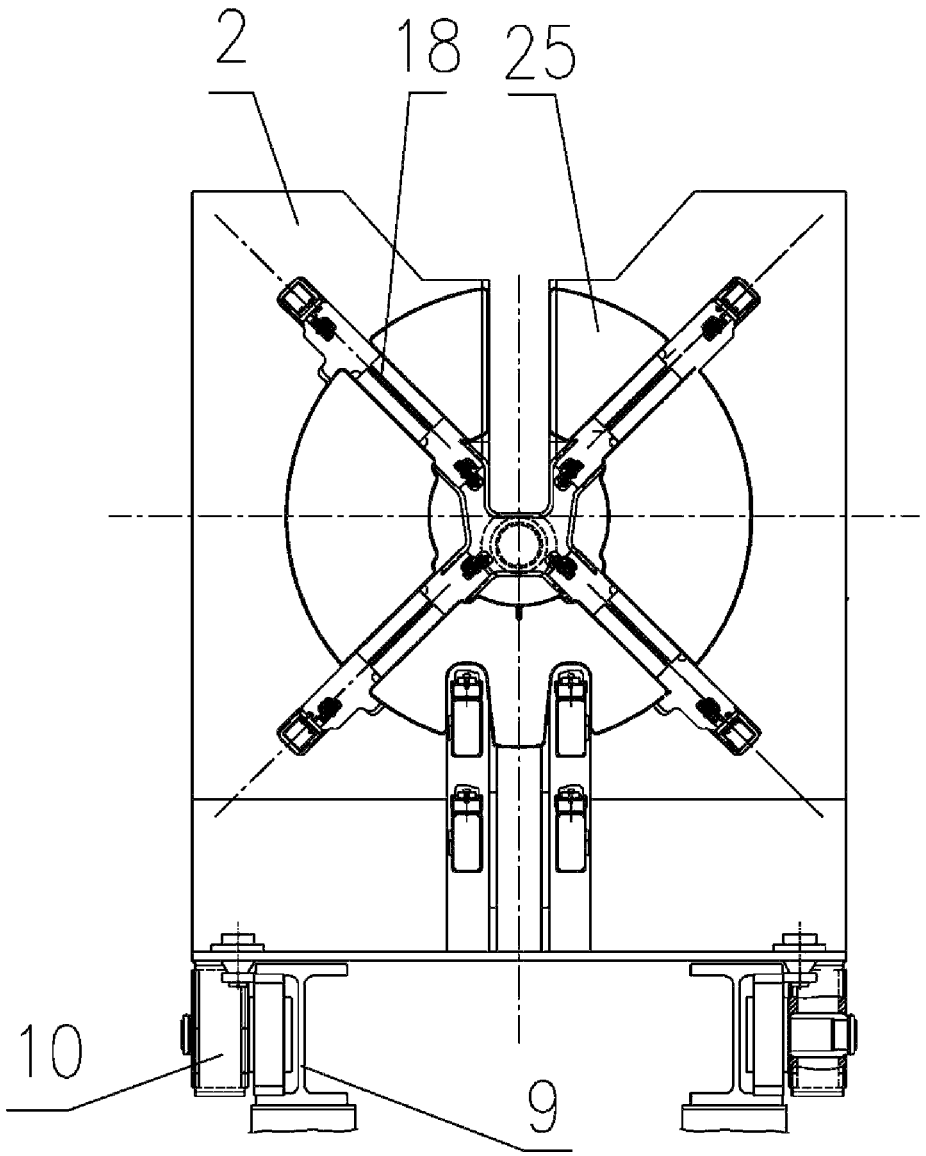
FIG. 3 is a structural schematic diagram of the pressing plates and observing opposite surfaces of the high speed wire rod baling machine in the prior art, including the filing-prevention disk and the wire grooves.
Figure 4:
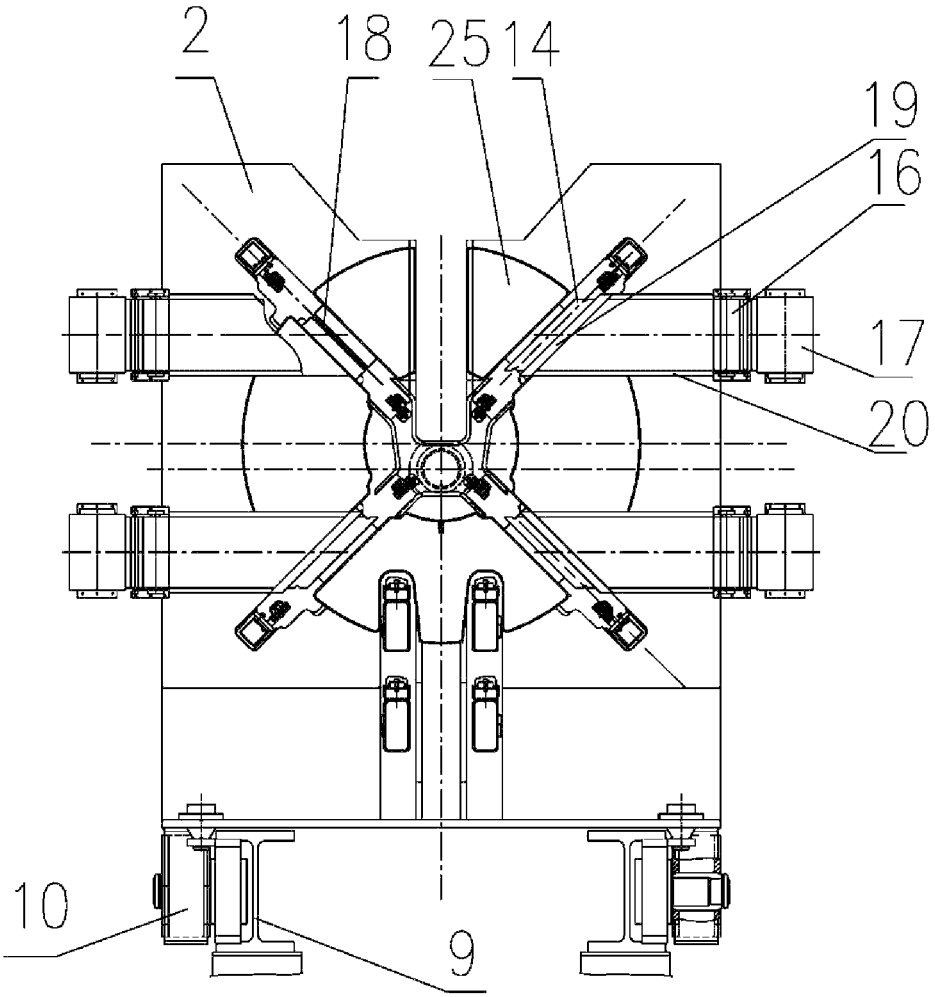
FIG. 4 is a schematic structural view of an embodiment of a gasket placement mechanism for a high speed wire rod baling machine based on FIG. 3 of the invention.
Figure 5:
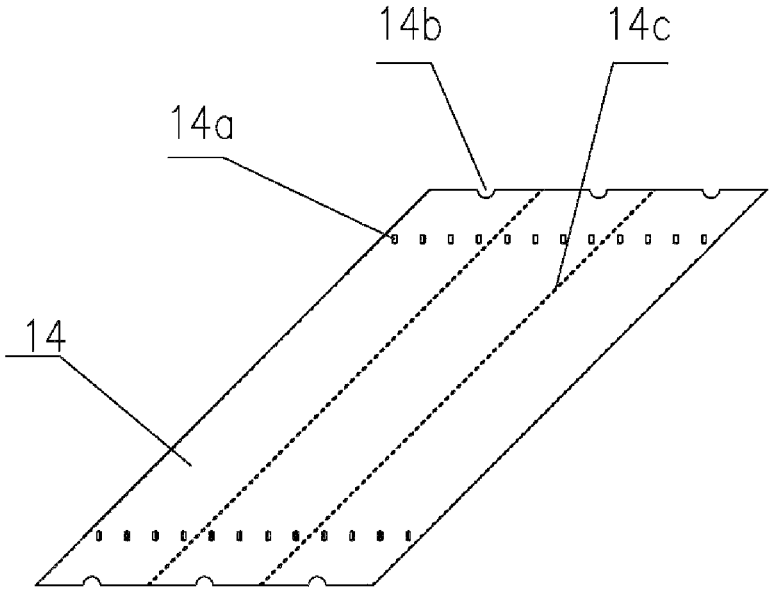
FIG. 5 is a schematic view of the structure of a section of gasket rolls formed by connecting a plurality of gaskets according to an embodiment of the invention.
Figure 6:
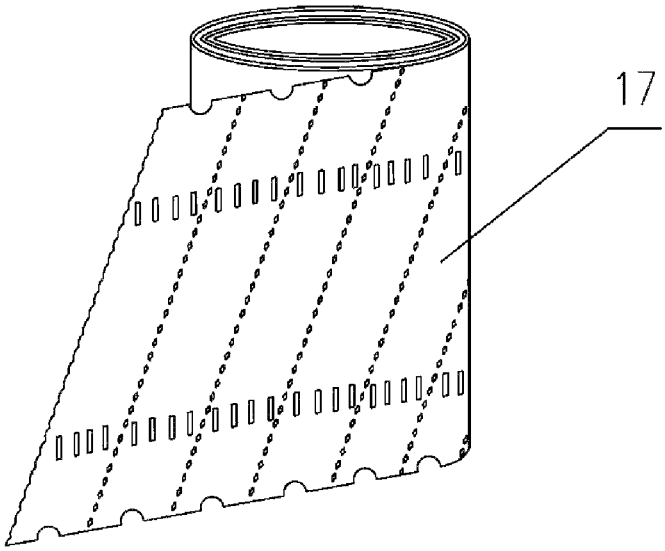
FIG. 6 is a perspective view of a section of gasket rolls according to an embodiment of the invention.
Figure 7:
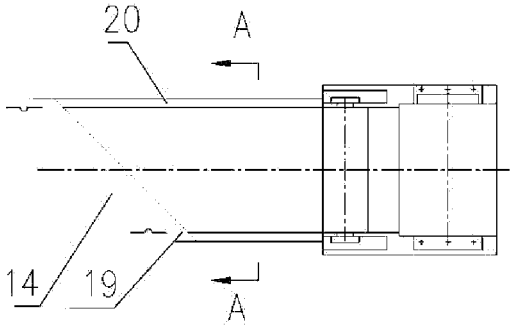
FIG. 7 is a schematic structural view of an embodiment of the invention including the conveying roller, the gasket roll, and the limit moving groove.
Figure 8:
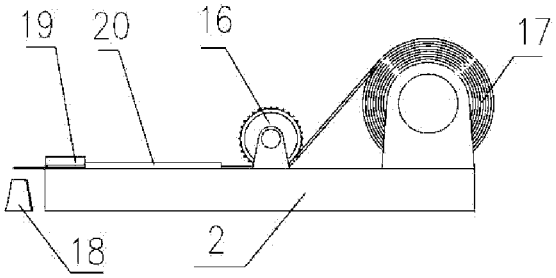
FIG. 8 is a bottom view of FIG. 7.
Figure 9:
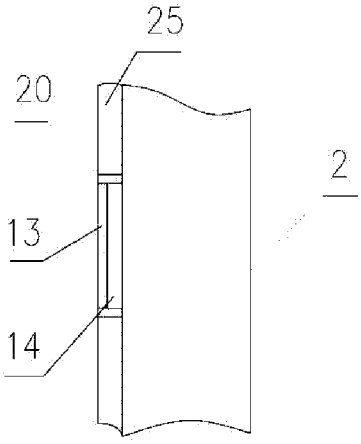
FIG. 9 is a cross-sectional view of A-A in FIG. 7, wherein the limit moving groove is a structural schematic diagram of a flat long groove formed by covering a flat plate.
Figure 10:
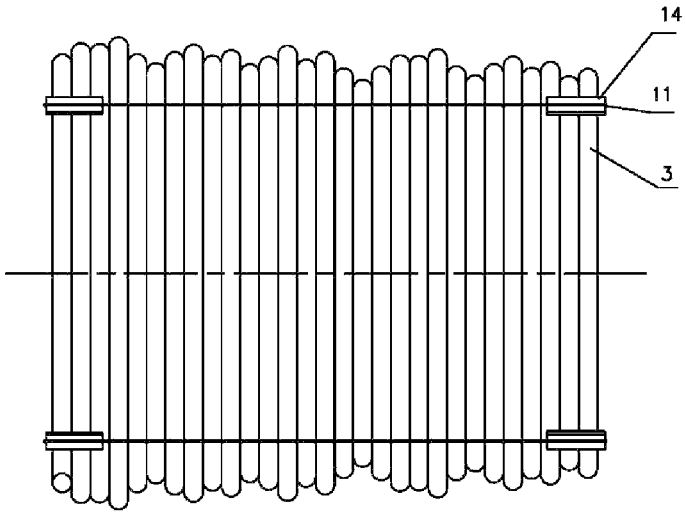
FIG. 10 is a schematic view of the structure of the wire rod of the invention that is the same as the prior art after being compressed and bundled, viewed from the outside.
Figure 11:
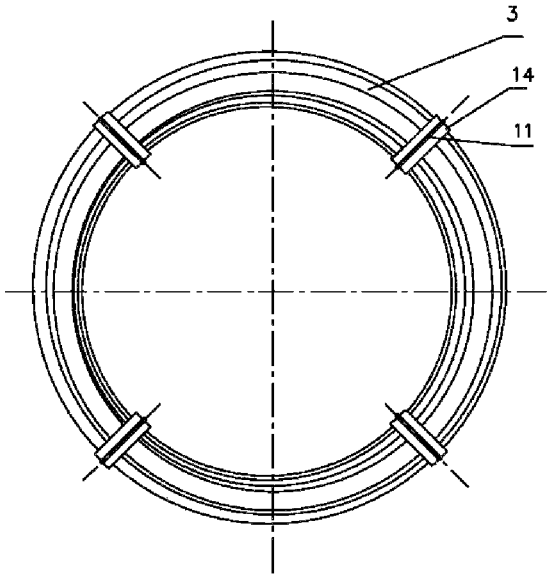
FIG. 11 is a schematic diagram of the structure of FIG. 10 viewed from both sides in a ring shape.
Figure 12:
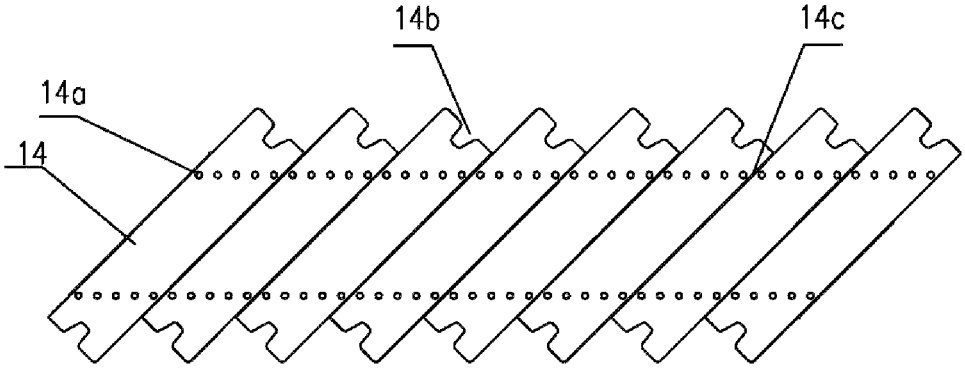
FIG. 12 is a schematic view of a section of unfolded gaskets formed by connecting a plurality of gaskets in another embodiment of the invention, wherein the gaskets are in long and narrow rectangle shape.

In the figures, 1 refers to the steel wire guide component; 2 refers to the pressing plate; 3 refers to the roll; 4 refers to the transmission hook; 5 refers to the baling head; 7 refers to the wire feeding mechanism; 8 refers to the lifting platform; 9 refers to the guide device; 10 refers to the wheel; 11 refers to the steel wire; 13 refers to the flat plate; 14 refers to the gasket; 14*a* refers to the conveying tooth hole; 14*b* refers to the banding guide hole; 14*c* refers to the sawtooth hole; 16 refers to the conveying roller; 17 refers to the gasket roll; 18 refers to the wire groove; 19 refers to the pressing strip; 20 refers to the limit moving groove; 25 refers to the filing-prevention disk.

DETAILED DESCRIPTION OF THE PREFERRED EMBODIMENTS

The invention will be described in detail hereinafter with reference to the drawings.

A gasket placement mechanism for a high speed wire rod baling machine, wherein the baling machine comprises two pressing plates 2 reciprocating at both ends in the direction of compression;

filing-prevention disks 25 which are in a circular shape and have a certain thickness are fixed on two opposite compression surfaces of the pressing plates 2; four diagonals of the pressing plates 2 along with the filing-prevention disks 25 are provided with four wire grooves 18 banding steel wires, and the wire grooves 18 divide the filing-prevention disks 25 into four sector plates of upper, lower, left and right;

four diagonals of the pressing plates 2 are provided with conveying rollers 16 and gasket rolls 17;

the gasket roll 17 consists of a large number of gaskets 14 connected side by side to form a long strip and wound into a roll shape, and the wrapping and winding direction of a single gasket 14 is on both sides of the unfolded gasket roll 17;

a numerical control motor drives the conveying rollers 16 to rotate so as to drive the gasket rolls 17 to unfold the gaskets 14 horizontally, and the unfolded gaskets 14 penetrate through a channel formed by the filing-prevention disks 25 to reach the position of the wire grooves 18 of the pressing plates 2; pressing strips 19 are provided at the notch of the wire grooves 18 and above the gaskets 14;

the conveying roller 16 is provided with at least one circle of protruding teeth in the circumferential direction for conveying the gaskets 14.

A gasket structure for the gasket placement mechanism for the aforementioned high speed wire rod baling machine, wherein the gaskets 14 are in a parallelogram shape, and the adjacent gaskets 14 are connected by means of the hypotenuses; the oblique direction of the hypotenuses is consistent with the direction of the wire grooves 18 on the pressing plates 2; sawtooth holes 14*c* or line-like concave indentations are provided between the adjacent gaskets 14;

or, the gaskets 14 are in a long and narrow rectangle shape, and the adjacent gaskets 14 are connected by means of the long edges; the long edge thereof is at an oblique angle to the horizontal, and the oblique direction is consistent with the direction of the wire grooves 18 on the pressing plates 2; sawtooth holes 14*c* or line-like concave indentations are provided between the adjacent gaskets 14;

the gaskets 1 are metal sheets; corresponding to the protruding teeth of the conveying roller 16 in the circumferential direction, conveying tooth holes 14*a* are provided at the corresponding unfolded positions of the gasket rollers 17.

The gasket structure that meets the above standards can meet the operation of the gasket placement mechanism used for the high speed wire rod baling machine. The sawtooth hole 14*c* is a general description, which has different shapes on the pressing plate wire grooves 18 on different models, and on different placement and pushing mechanisms, such as a complete needle-punched hole, or a line slit type, or a combination of the two, and so on, as long as it is convenient for the gasket 14 to be wound into a rolled gasket roll 17, and for the conveying roller 16 to push or the gasket clamping unit and the lateral pushing unit to push the gasket 14 to the notch of the wire groove 18, and also conducive to strangulation when the steel wire is banded.

When the gasket 14 is in a parallelogram shape, the gasket is easy to be processed and manufactured, the corresponding mold is simple, and the cost is low. When the gasket 14 is in a long and narrow rectangle shape, the force is more even and reasonable when the adjacent gaskets are strangled and banded by the wire, the banding quality is good, and the effective banding length of the gaskets of the same length is long.

The gaskets 14 are aluminum sheets, copper sheets or steel sheets; steel sheet is a relatively preferred metal sheet, with a wide range of sources and convenient hardness, which can be recycled and reused after use.

The thickness of the gaskets 14 is 0.1-1 mm; according to the weight of the banding, the requirements of the wire rod, the hardness and rigidity of the metal, the thickness of the range is selected.

The gaskets 14 are steel sheets with a thickness of 0.2 mm. The gasket of such a material and thickness can be compressed and deformed in a range that can be used for the general wire rod banding, which will not damage the wire rod, but also preserve the gasket without being damaged, and does not waste material with too thick thickness. The price of steel sheet is low and the source is wide.

The hypotenuses of the gaskets 14 in a parallelogram shape or the long edges in a long and narrow rectangle shape form an angle of 45 degrees with the horizontal line. Generally, the pressing plate of the high speed wire rod baling machine is provided with four wire grooves for banding steel wires at the four diagonal corners of the filing-prevention disk surface and the horizontal at 45 degrees. Therefore, the angle between the oblique side of the gasket 14 and the horizontal line is 45 degrees, which corresponds to the structure of the existing conventional wire rod baling machine. Of course, if there is an angle greater than or less than this angle in the market, and in order to be applied to the device of the invention to achieve the same purpose, it should be regarded as the principle and effect of "equivalence", which also falls into the protection scope of the patent.

The unfolded upper and lower sides of the gasket rolls 17 are respectively provided with a row of circular, rhombic or rectangular conveying tooth holes 26. Such holes are easy to be processed and formed to achieve the purpose of the invention, and the upper and lower sides and two rows of conveying are relatively stable.

Banding guide holes 14*b* are provided in the middle of the two horizontal sides of the gaskets 14 in a parallelogram shape or the two short edges in a long and narrow rectangle shape. In order to make the operation "precise" and improve the quality of the steel wire banding without deflection, guide holes 14*b* are provided to facilitate the steel wire to easily enter and slide into the guide holes 14*b* in the middle of the baling side of the gasket, without causing deviation during subsequent movement, which more ensure the quality of baling.

The banding guide holes 14*b* are semicircular holes with a diameter of 5-12 mm or rectangular holes with a width of 15-35 mm and a depth of 5-15 mm. According to experience and calculations, the banding effect in this range is better.

The invention is not limited to the above embodiments. On the basis of the technical solutions disclosed in the invention, those skilled in the art can make some substitutions and modifications to some of the technical features without creative efforts according to the disclosed technical content, which shall all fall within the protection scope of the invention.

The invention claimed is:

1. A gasket placement mechanism for a high speed wire rod baling machine, wherein:

the gasket placement mechanism comprises two pressing plates reciprocating at both ends of the baling machine along a direction of compression;

the gasket placement mechanism further comprises filing-prevention disks which are in a circular shape, have a certain thickness, and are fixed on two opposite compression surfaces of the pressing plates;

four diagonals of the pressing plates and the filing-prevention disks are provided with four wire grooves for receiving steel wires, and the wire grooves divide the filing-prevention disks into an upper sector, a lower sector, a left sector, and a right sector;

the four diagonals of the pressing plates are provided with conveying rollers and gasket rolls;

each gasket roll consists of a number of gaskets connected side by side to form a long strip and wound into a roll shape, and a wrapping and winding direction of a single gasket is on both sides of the gasket roll when the gasket roll is unfolded;

the gasket placement mechanism further comprises a numerical control motor which drives the conveying rollers to rotate so as to drive the gasket rolls to unfold the gaskets horizontally, and the unfolded gaskets penetrate through a channel formed by the filing-prevention disks to reach a position of the wire grooves of the pressing plates;

pressing strips are provided at a notch of the wire grooves and above the gaskets; and the conveying rollers are provided with at least one circle of protruding teeth in a circumferential direction for conveying the gaskets.

2. The gasket placement mechanism according to claim 1, wherein:

the gaskets are in a parallelogram shape, and adjacent gaskets are connected by means of hypotenuses of the parallelogram shape; an oblique direction of the hypotenuses of the parallelogram shape is consistent with a direction of the wire grooves on the pressing plates; sawtooth holes or concave indentations are provided between the adjacent gaskets;

or, the gaskets are in a long and narrow rectangle shape, and adjacent gaskets are connected by means of long edges of the rectangle shape; each long edge of the gaskets is at an oblique angle to a horizontal direction, and an oblique direction of the long edges is consistent with the direction of the wire grooves on the pressing plates; sawtooth holes or concave indentations are provided between the adjacent gaskets;

the gaskets are metal sheets; and corresponding to the protruding teeth of the conveying rollers in the circumferential direction, conveying tooth holes are provided at corresponding unfolded positions of the gasket rolls.

3. The gasket placement mechanism according to claim 2, wherein the gaskets are aluminum sheets, copper sheets or steel sheets.

4. The gasket placement mechanism according to claim 2, wherein a thickness of the gaskets is 0.1-1 mm.

5. The gasket placement mechanism according to claim 4, wherein the gaskets are steel sheets with a thickness of 0.2 mm.

6. The gasket placement mechanism according to claim 2, wherein the hypotenuses of the parallelogram shape or the long edges of the rectangle shape form an angle of 45 degrees with the horizontal direction.

7. The gasket placement mechanism according to claim 2, wherein unfolded upper and lower sides of the gasket rolls are respectively provided with a row of circular, rhombic or rectangular conveying tooth holes.

8. The gasket placement mechanism according to claim 2, wherein banding guide holes are provided in the middle of two horizontal sides of the gaskets in the parallelogram shape or in the middle of two short edges of the gaskets in the long and narrow rectangle shape.

9. The gasket placement mechanism according to claim 8, wherein the banding guide holes are semicircular holes with a diameter of 5-12 mm or rectangular holes with a width of 15-35 mm and a depth of 5-15 mm.

* * * * *